US005191696A

United States Patent [19]

Kishi et al.

[11] Patent Number: 5,191,696

[45] Date of Patent: Mar. 9, 1993

[54] METHOD FOR JOINING ROLLED PLATES

[75] Inventors: Osamu Kishi; Kanji Hayashi; Hideaki Furumoto; Osamu Miyamoto; Kazuo Morimoto; Hideki Akita; Yasuyuki Yoshida; Ikuo Wakamoto, all of Hiroshima, Japan

[73] Assignee: Mitsubishi Jukogyo Kabushiki Kaisha, Tokyo, Japan

[21] Appl. No.: 774,181

[22] Filed: Oct. 9, 1991

[30] Foreign Application Priority Data

| | | | |
|---|---|---|---|
| Oct. 15, 1990 | [JP] | Japan | 2-273219 |
| Oct. 15, 1990 | [JP] | Japan | 2-275889 |
| Nov. 7, 1990 | [JP] | Japan | 2-299810 |

[51] Int. Cl.[5] ..... B21D 39/00

[52] U.S. Cl. ..... 29/521; 29/522.1; 29/524

[58] Field of Search ..... 29/445, 514, 521, 522.1, 29/524

[56] References Cited

U.S. PATENT DOCUMENTS

| | | | |
|---|---|---|---|
| 70,383 | 10/1867 | Wilmot | 29/524 |
| 556,819 | 3/1896 | Hartman | 29/524 X |
| 2,123,626 | 7/1938 | Fiegel | 29/524 |
| 3,099,238 | 7/1963 | Jones | 29/524 X |
| 3,301,992 | 1/1967 | Seeloff | 29/524 |
| 4,805,592 | 2/1989 | Enami | 29/321 X |

FOREIGN PATENT DOCUMENTS

| | | |
|---|---|---|
| 213379 | 10/1985 | Japan . |
| 231504 | 11/1985 | Japan . |

OTHER PUBLICATIONS

Patent Abstracts of Japan, Unexamined Appl. vol. 5, No. 147, Sep. 17, 1981 Kokai No. 56-77008 (Sumitomo Kinzoku Kogyo K.K.).

Patent Abstracts of Japan, Unexamined Appl. vol. 10, No. 96, Apr. 12, 1986. Kokai No. 60-231504 (Mitsubishi Jukogyo K.K.).

*Primary Examiner*—Timothy V. Eley

*Attorney, Agent, or Firm*—McAulay Fisher Nissen Goldberg & Kiel

[57] ABSTRACT

In a continuous rolling line wherein the tail end part of a preceding rolled plate and the head end part of a following rolled plate are joined subsequently to a rough rolling and subjected to a following continuous finish rolling: a joining method of rolled plates wherein the tail end of the preceding rolled plate and the head end of the following rolled plate are formed into a nearly rectangular convex and concave shape respectively so as to inlay each other, the convex part and the concave part being combined each other in the same plane as the rolling lines, and then being fed to the continuous finish rolling; a joining method rolled plates wherein the side surface of the parallel inlay is formed in a taper shape in the direction of the plate thickness at any desired location of either the tail end part of the preceding rolled plate or the head end part of the backward rolled plate or of the both parts, and then being fed to the continuous finish rolling; and a joining method of rolled plates wherein the cut parts of the preceding and the following rolled plates are inlaid each other at the same plane, and joining only a part of the side edge of the inlay.

8 Claims, 15 Drawing Sheets

METHOD FOR JOINING ROLLED PLATES

FIELD OF THE INVENTION AND RELATED ART STATEMENT a. Field of the Invention

The present invention relates to a joining method for roughly rolled plates on a continuous hot roll line wherein roughly rolled plates are joined and subjected to a continuous finish rolling.

b. Related Art Statement

Conventionally, when hot rolling is carried out, a plate subsequent to rough milling is wound once into a coil which is to be rewound prior to finish rolling. There have been many problems, however, in such a discontinuous rolling such as uneven thickness at the top and tail parts of the product, severe vibrations due to bite or irregular ending at the tail part in course of passing the plate, damages of the roll surfaces, irregular running of the rolled plate, crops loss and the like. In order to overcome these problems, various methods for making the ends of roughly rolled plates join each other by a hot joining have been proposed.

One of proposals made previously is a rolling line shown in FIG. 9 wherein cutting units 10 and 11 are located above and under the line L, respectively, and guide paths 12 and 13 for the rolled plate to the cutting units 10 and 11 are provided as well.

Each of cutting units 10 and 11 has an upper edge 14 and a lower edge 15 having a plurality of convex parts of which top portion width is larger than the width of the base portion as shown in FIG. 10. By these edges, the rolled steel plate is cut along with the cutting lines of the edges 14 and 15.

In FIG. 9, reference numerals 16, 17, 18, and 19 indicate the edge rests and 20 the stopper for the rolled steel plate. Reference numeral 21 indicates a table roller and 22 a guide plate.

In this rolling line, a plate to be rolled is guided by the guide paths 12 and 13 whereby a guide route is formed with movements of the table roller 21 and the guide plate 22 upward or downward as shown by the dotted lines. The top part and tail part of the plate being guided are cut with the upper and lower cutting units 10 and 11, and the plate is simultaneously transferred to a finish rolling line. In this way, convex and concave parts formed at the both ends of the rolled plates are complemented each other and form an inlay; thus, joining is performed.

The joining method shown in FIG. 9 creates problems, however, because pressures on the plate being rolled from upside and downside are necessary. Therefore, large scale guide paths 12 and 13 for the rolled plate have to be installed, increasing the cost for the rolling line equipment. In addition, burr which occurs at the cut surfaces when the plate is cut with the shearing force causes difficulty in the inlaying. Other proposed methods also have problems such as excessively large equipment or a long period of time for the joining.

Another proposal is a method shown in FIGS. 11 (*a*), (*b*), and (*c*) wherein the edges of two sheets of roughly rolled plates 31 and 31' to be joined are made into jigsaw shapes 32 and 32' whose edge opening has a width which is narrower than the width of the internal end part, making a complementary inlay between each other. According to this method, strong joining results since the inlaying part of the jigsaw shape is able to withstand the tension applied to the proceeding direction of the plate until the stress causes plastic deformation. However, it is disadvantageous that each sides of the jigsaw shaped inlaying does not constitute a complete assembly as one body, and therefore, up and down movements of the plates such as winding to a looper easily cause the disengagement. Furthermore, since the two plate sheets cannot be inlaid in the same plane, the following sheet has to be introduced to the upward (or downward) position of the preceding sheet and either one of the sheet plates has to be moved upward or downward; that is, complicated procedures are necessary.

Various other methods such as pressure application, riveting, clamping, tack welding and the like have been put into practice.

OBJECT AND SUMMARY OF THE INVENTION

The present invention has been made in view of the situations explained above. An object of the present invention is to provide a method wherein a preceding rolled plate and a following rolled plate are joined in a short period of time with a compact equipment.

When a plate is cut, the cutting surface is perpendicular to the front and back surfaces. Therefore, the cutting surfaces of the preceding rolled plate and the following rolled plate are weak against upward and downward force unless the both surfaces constitute one body. The present invention provides a joining method of rolled plates whereby the inlaying part is prevented from being easily separated in the up and down direction.

The present invention relates to a method wherein the inlaying part is made into a parallel shape; the preceding plate and the following plate are butted in the same plane to form inlay; and the parallel inlaying part is made into a jigsaw shape by utilization of uneven widths occurring at the time of rolling. If the parallel inlaying part is left as such until the jigsaw shape is formed, there is no resistance against the force in the direction of the plate proceeding; thus, the preceding plate will easily separate from the following plate.

Another object of the joining method of rolled plates according to the present invention is to provide a novel method to prevent separation of the preceding and following plates until the parallel inlaying turns to a jigsaw shape by a finish rolling.

That is, a first point of the present invention is a joining method of rolled plates in a continuous rolling line wherein the tail end part of a preceding rolled plate and the head end part of a following rolled plate are joined subsequently to rough rolling and subjected to continuous finish rolling, characterized by:

forming the tail end of the preceding rolled plate and the head end of the following rolled plate into a nearly rectangular convex and concave shape so as to inlay each other;

combining the convex part and the concave part in the same plane as the rolling line; and then subjecting to the continuous finish rolling.

A second point of the present invention is a joining method of rolled plates in a continuous hot rolling line wherein the tail end part of a preceding rolled plate and the head end part of a following rolled plate are joined subsequently to rough rolling and subjected to continuous finish rolling, characterized by:

cutting the plates so that the head and tail end parts form a parallel inlay;

forming the side surface of the parallel inlay in a taper shape in the direction of plate thickness at any desired location of either the head end part or the tail end part or the both parts; and joining the head end of the following plate with the tail end of the preceding plate by inlaying the both ends in the same plane and by utilization of volume filling due to uneven widening of the plates during rolling.

A third point of the present invention is a joining method of rolled plates in a continuous hot rolling line wherein the tail end part of a preceding rolled plate and the head end part of a following rolled plate are joined subsequently to rough rolling and subjected to continuous finish rolling, characterized by:

cutting the head end part and the tail end part of the respective roughly rolled plates so as to form a parallel inlay shape in such a way that the both ends are able to inlay by butting each other in the same plane;

inlaying the cut parts each other complementarily in the same plane; and then joining only a part of the side edge of the inlay.

Hereunder, preferred embodiments of the present invention are explained.

BRIEF DESCRIPTION OF THE DRAWINGS

FIGS. 1 and 2 show a side view and a plan view of a tail end part of a preceding rolled plate.

FIGS. 3 to 5 are explanatory drawings showing a joining method for rolled plates.

FIGS. 6 to 8 are plan views showing actual width broadening conditions of rolled plates.

DETAILED DESCRIPTION OF PREFERRED EMBODIMENTS

Figure 1:
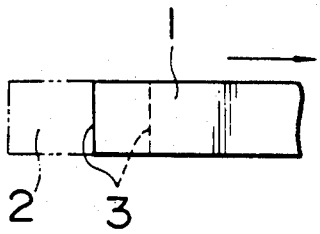
FIGS. 1 to 8 show examples of embodiments of the present invention.
Figure 2:
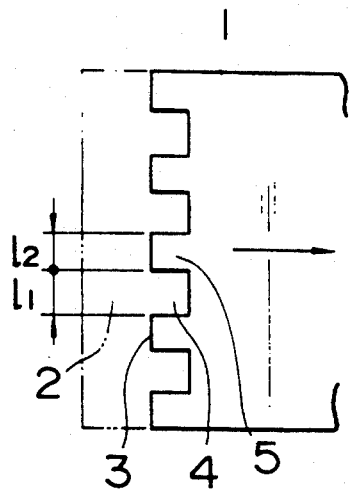
Figure 3:
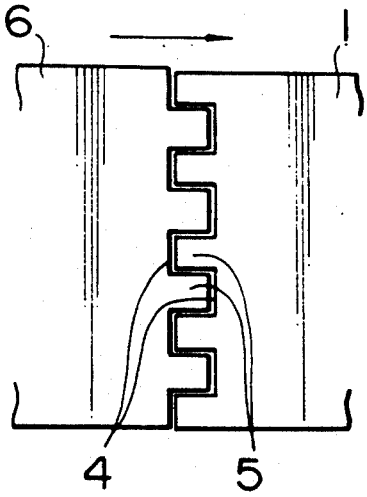
Figure 4:
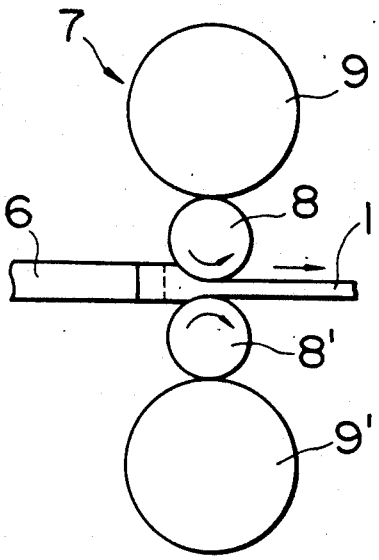
Figure 5:
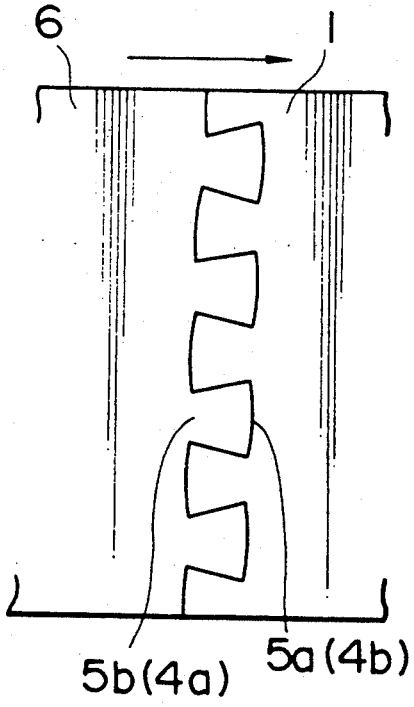
Figure 8:
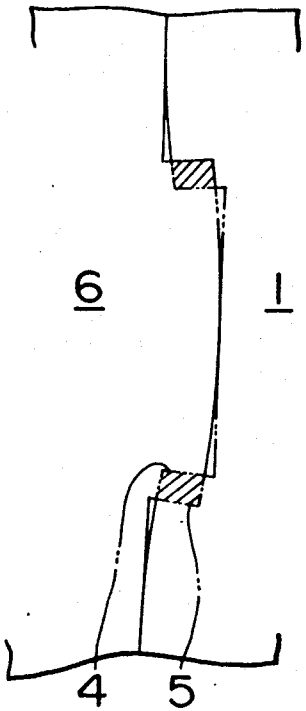
Figure 7:
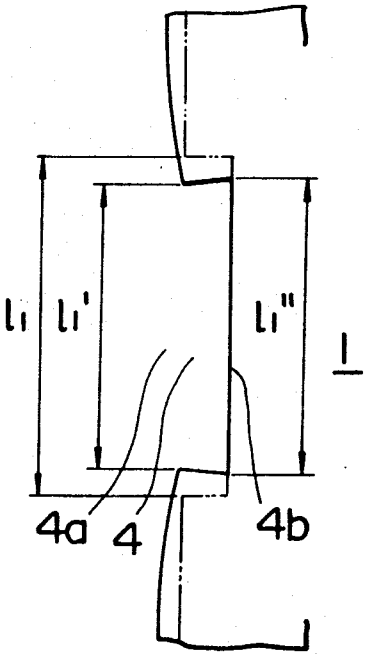
Figure 6:
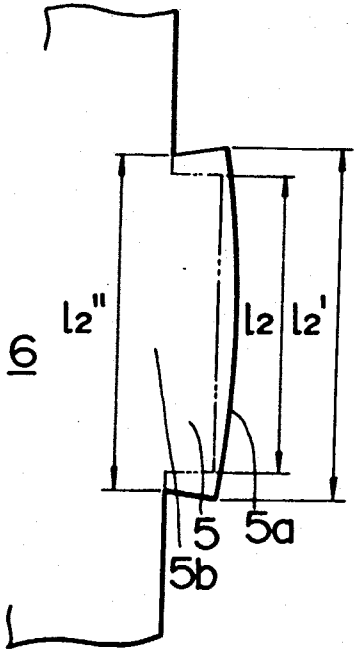
Figure 9:
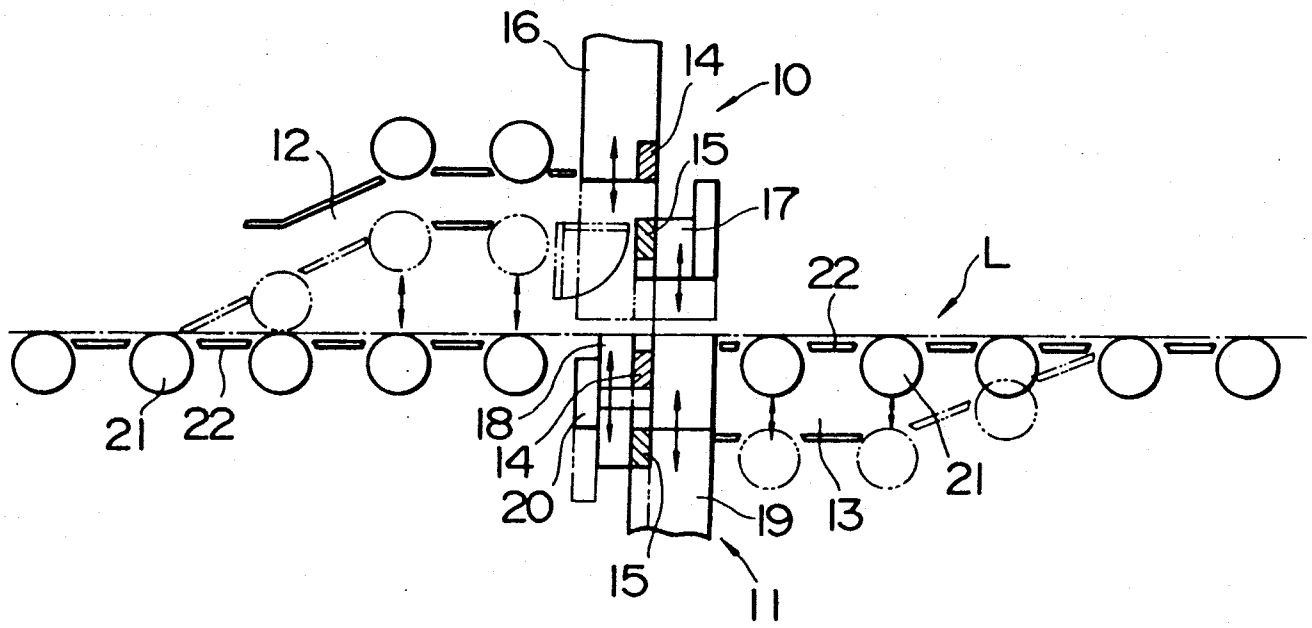
FIG. 9 PRIOR ART
FIG. 9 shows an example of rolling line schematically adopting a conventional joining method and FIG. 10 is a plan view of the cutting edge in the example shown in FIG. 9.
Figure 10:
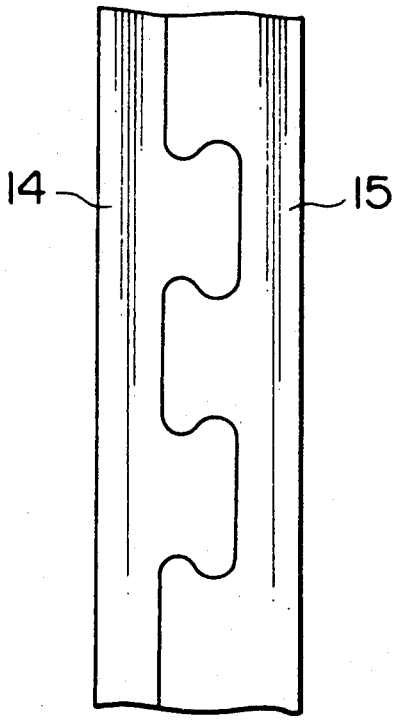
FIG. 10 PRIOR ART
Figure 11A:
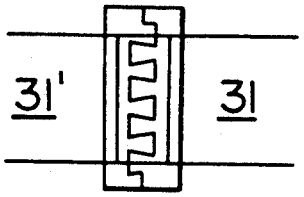
FIG. 11(a) PRIOR ART
FIGS. 11(*a*), (*b*), and (*c*) explain conventional joining parts of rolled plates.
Figure 11B:
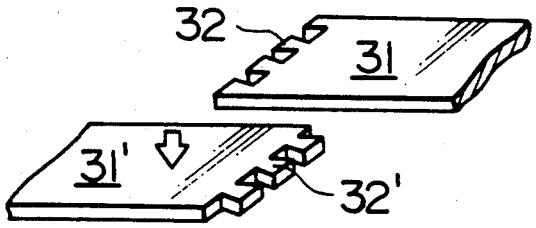
FIG. 11(b) PRIOR ART
Figure 11C:
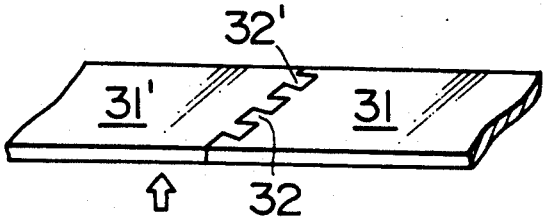
FIG. 11(c) PRIOR ART
Figure 12A:
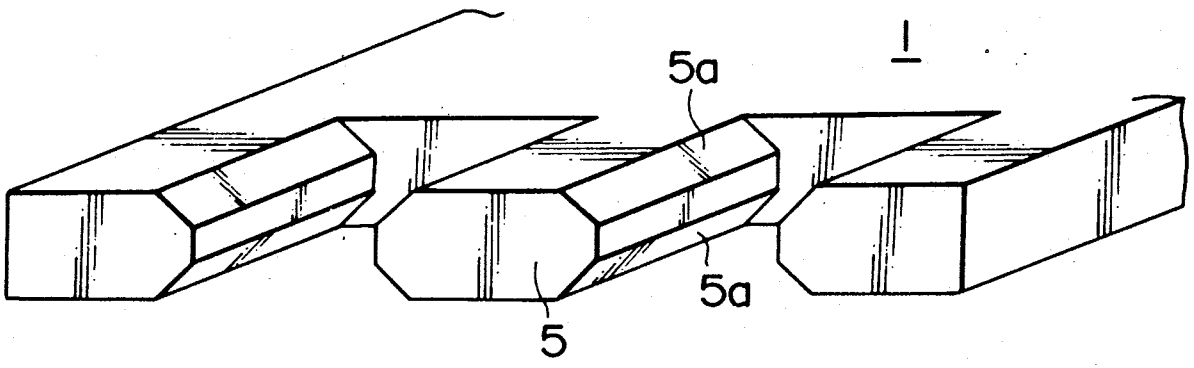
FIGS. 12(*a*), (*b*), (*c*) and (*d*) explain another example of embodiment of the present invention.
Figure 12B:
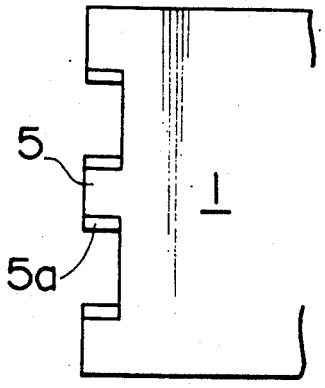
Figure 12C:
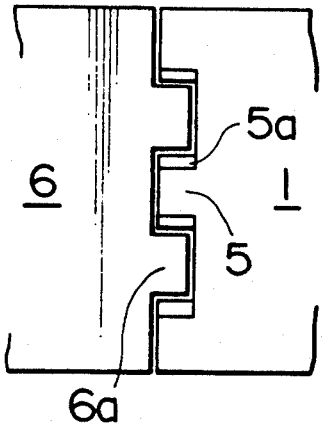
Figure 12D:
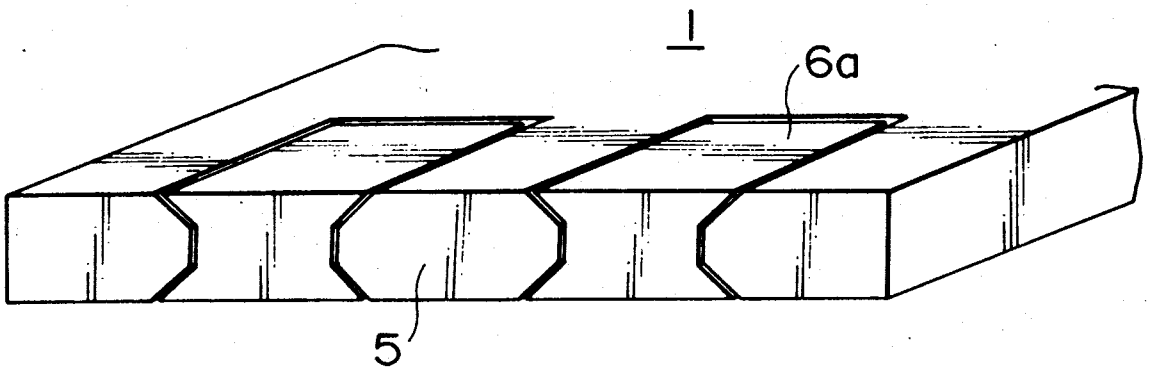

FIGS. 1 to 8 show examples of embodiments of the present invention. FIGS. 1 and 2 show a side view and a plan view of a tail end part of a preceding rolled plate. FIGS. 3 to 5 show a joining method for rolled plates. FIGS. 6 to 8 show actual width broadening conditions of rolled plates by way of plan views.

As shown in FIG. 1, the tail part of the preceding plate 1 is cut along with a cutting line 3 avoiding a crop part 2 in this example. As shown in FIG. 2, the shapes of the ends after the cutting are formed so that a rectangular concave part 4 and convex part 5 are in succession. The width $l_1$ of the concave part 4 is made greater than the width $l_2$ of the convex part 5.

The head part of the following rolled plate is cut into a similar shape. These cutting procedures are made independently on the rolling path line.

When the cutting is completed, both are moved toward the rolling direction. Then, on the same path line, the tail end part of the preceding rolled plate 1 and the head end part of the following rolled plate 6 are combined in such a way that respective convex part 5 is inlaid (engaged) into the counterpart concave part 4 with an opening space; thereafter, the assembly is rolled with a finishing mill 7 as shown in FIG. 4. In the figure, reference numerals 8 and 8' indicate work rolls; and 9 and 9' back up rolls.

By the rolling, the head end portion 5*a* of the respective convex part 5 considerably enlarges due to free deformation in the plate width direction; contrary, the head end portion 4*a* of a concave part 4 is made narrow. In contrast, the respective root parts 4*b* and 5*b* are restricted by the rolled plates 1 and 6 and unable to expand. As the result, the preceding rolled plate 1 and the following rolled plate 6 are engaged in fitness between each other and joined firmly as shown in FIG. 5.

In FIGS. 6 and 7, conditions when convex 5 and concave 4 are rolled individually are shown. As shown in these figures, the width l' of the head end 5*a* of the convex part after the rolling becomes greater than the width l' of the tail end 5*b*; the width $l_1'$ of the head end 4*a* of the concave part 4 becomes smaller than the width $l_1''$ of the tail end 4*b*. The widths $l_2'$ and $l_2''$ of the convex part 5 are, in contrast to before the rolling, becomes greater than the widths $l_1'$ and $l_1''$ of the concave part 4 as a whole. Accordingly, when rolled in the combination, as shown in FIG. 8, the shaded parts engage sharply in fitness with each other, forming a strong joint.

According to the above explained invention, the tail end of the preceding rolled plate and the head end of the following rolled plate are formed into a nearly rectangular convex and concave shape so as to inlay each other, and the convex part and the concave part are combined with each other in the same plane as the rolling line; followed by subjecting the assembly to join by the finish rolling. In this way, the effects that the joining equipment can be smaller and that the period of time for the joining becomes shorter have been realized.

Another embodiment example of the present invention is explained by way of FIGS. 12(*a*), (*b*), (*c*), and (*d*).

FIG. 12(*a*) shows an example of the tail end of the preceding rolled plate 1 or the head end of the following rolled plate 6 wherein a taper surface 5*a* is formed in the direction of the plate thickness from the front and back surfaces on both sides of the parallel inlay convex part 5. FIG. 12(*b*) is a plan view observing FIG. 12(*a*) from upside; 5*a* indicates the taper surface.

FIG. 12(*c*) shows the condition where the head end part of the following rolled plate 6 is inlaid into the tail end of the preceding rolled plate mutually in parallel (or where the tail end part of the preceding rolled plate 1 is inlaid into the top end of the following rolled plate). In this case, no taper part is installed in the parallel inlay convex part 6a of the following rolled plate 6 contacting the tail end part of the preceding rolled plate 1.

When the inlay part is rolled in a condition of FIG. 12(*c*), the head end portion of the convex part enlarges significantly in the plate width direction and turns into a shape like a fan biting the adjacent convex part. The portion of the plate material widened from the convex part 6a of the tail end part of the following rolled plate 6 moves toward the taper part 5a installed at the convex part 5 of the tail end part of the preceding rolled plate 1 and turns into something like FIG. 12(*d*). That is, convex parts 5 and 6a are mutually entangled in the up and down direction and strongly resist for ces in the up and down direction.

Figure 13:
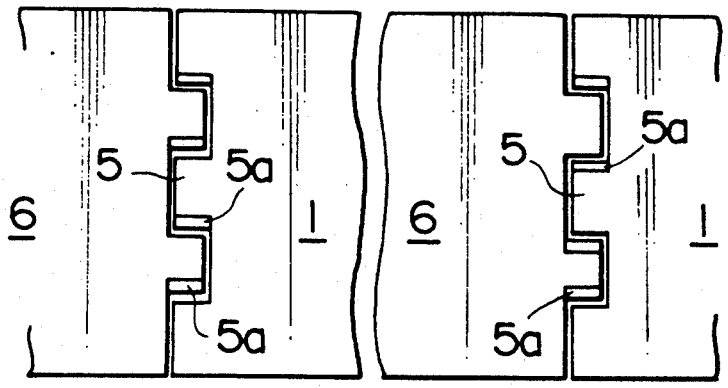
FIG. 13 explains still another example of embodiment of the present invention.
Figure 14A:
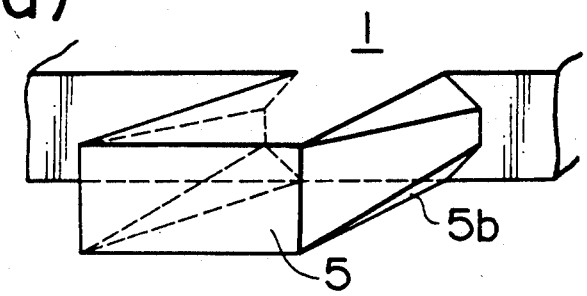
FIGS. 14(*a*) and (*b*) are plan views of joining parts of rolled plates of another example of the present invention.
Figure 14B:
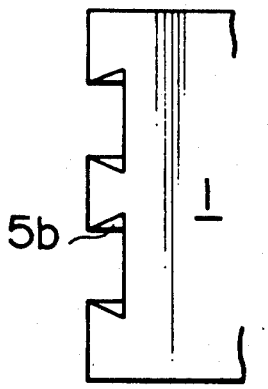

The taper part 5a is to be formed on the side surface of either convex part 5 or 6a. Thus, while all tapering may be installed on the side of the convex part 5 as in FIG. 12; it may be located only on one side of the convex part 5 as well like the case of FIG. 13. In addition to the cases where the taper part is formed along with the whole length of convex part 5, it is also within the scope of the present invention that a large notch is formed at the root part 5b corresponding to the top edge as shown in FIGS. 14(*a*) and (*b*).

In the invention just explained above, head and tail ends of plates are separately processed for cutting and taper formation, and both are to be simply inlaid in parallel on the same path line without additional works; that is, such complicated operations as required for conventional inlaying with a jigsaw shape, wherein the path lines of preceding and following rolled plates are slided and the plates themselves are moved upward or downward, become unnecessary.

Furthermore, strong joining is expected since a great contact pressure may be generated between the joining surfaces by utilizing the plastic deformation pressure in the rolling process. By effects of the taper part formed in the plate thickness direction in the joining part, the parallel inlay part is entangled toward the rolling direction as well as toward the plate thickness direction in the rolling process. Thus, stable rolling is possible without rapture due to the tension in the rolling direction and due to push up force of the looper in the plate thickness direction.

Still another embodiment example of the present invention is explained referring to FIG. 5.

Figure 15:
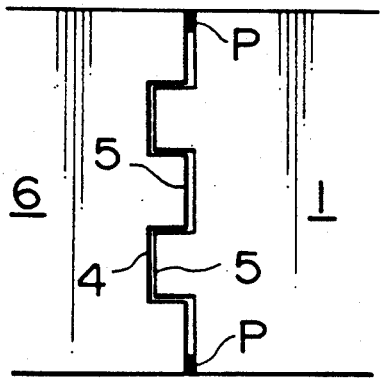
FIG. 15 shows still another example of embodiment of the present invention.

In FIG. 15, reference numeral 1 indicates a preceding rolled plate and 6 a following rolled plate. The tail end part of the preceding rolled plate and the head end part of the following rolled plate subsequent to rough rolling are cut by an unshown cutting machine so as to form parallel inlay shapes 4 and 5 which are able to butt each other in the same plane to form an inlay. The cut parts are inlaid mutually in complement in the same plane. Then, only parts P,P of the inlay side edges are joined by an unshown joining machine.

The plates are introduced into a finishing mill train in such a condition as only parts of the side edges are joined; the preceding and following rolled plates are continuously rolled.

Figure 16:
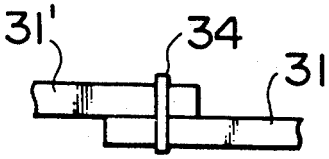
FIG. 16 explains a convenional riveting method.
Figure 17:
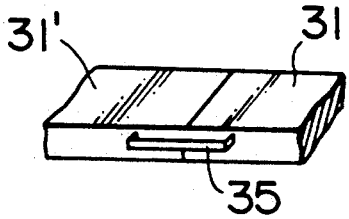
FIG. 17 explains a conventional continuous clamping method.
Figure 18:
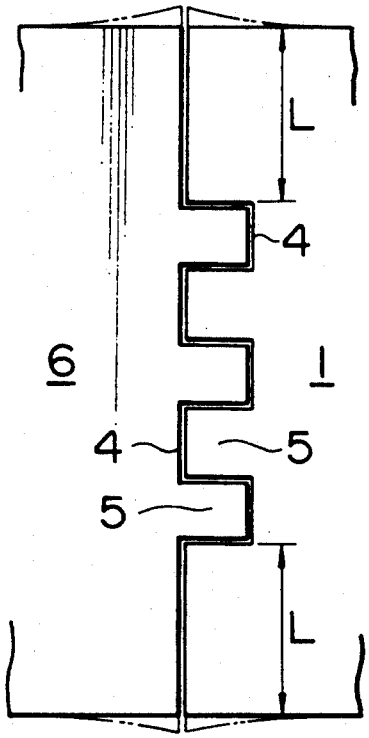
FIGS. 18 to 21 show still other examples of the present invention which are variations of the one shown in FIG. 3.
Figure 19:
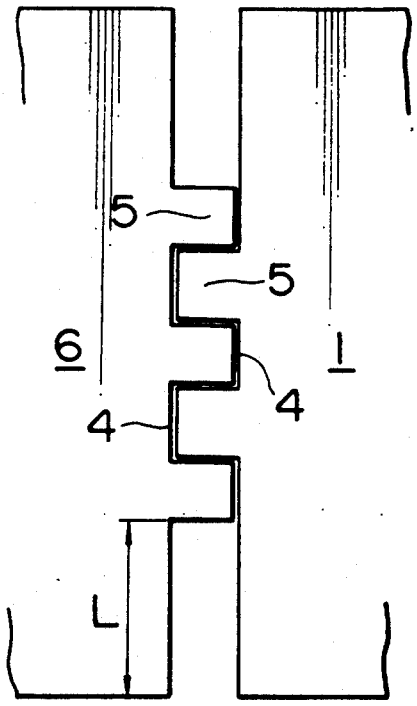

As for the joining procedures for joining the side edges only, for examples, conventionally well known mechanical joining methods such as riveting shown in FIG. 16, and clamping shown in FIG. 17; conventional arc welding; shock large current pressure welding (Japanese Patent Provisional Publication No. 075488/1986 (61-075488)); and any other methods capable of joining plates may be employed.

Other examples of the present invention are explained with reference to FIGS. 18 to 21.

Figure 20:
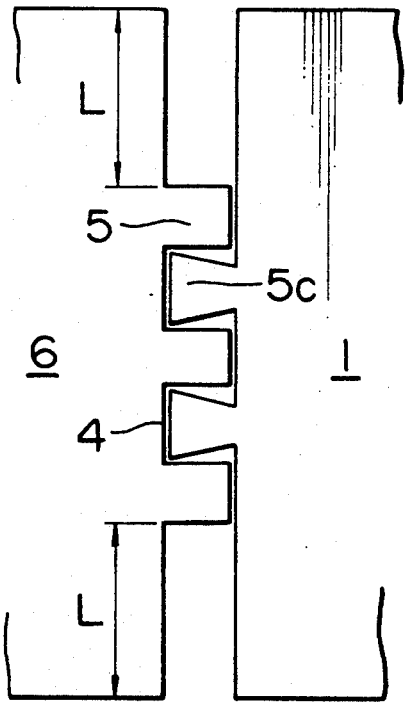
Figure 21:
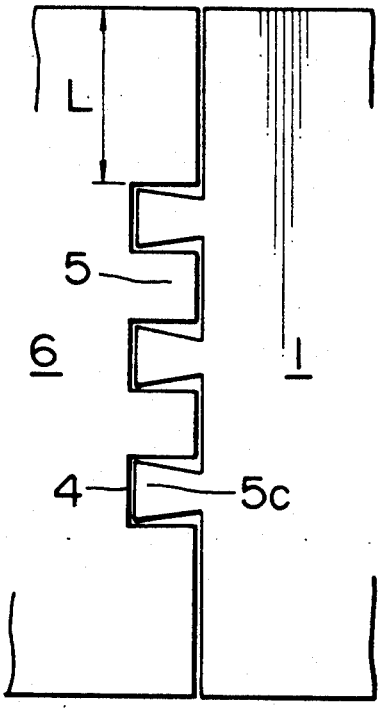

In these examples, the concave and convex parts are provided only at the center end portion of the preceding rolled plate 1 and the following rolled plate 6, and a flat portion L is provided on either side of the center end portion. With this arrangement of the concave and convex parts, the deformation of the rolled plates 1 and 6 in the width direction can be prevented as indicated by the broken lines in FIG. 18. As shown in FIGS. 20 and 21, when the portion L of the rolled plate 6 is cut out or the concave part 5c is shaped as shown, the effect of preventing deformation at the sides of the rolled plate is considerable.

Figure 22A:
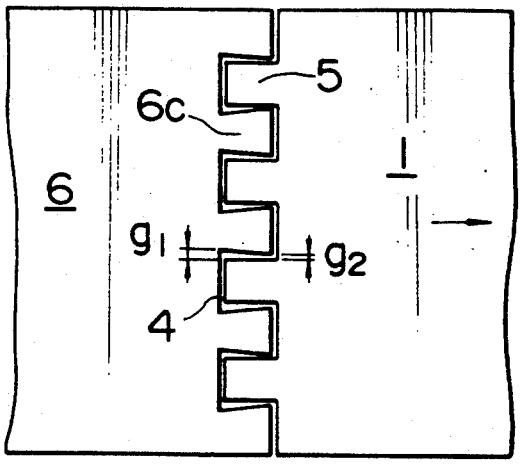
FIGS. 22(*a*) and (*b*) show still another example which is also a variation of the one shown in FIG. 3.
Figure 22B:
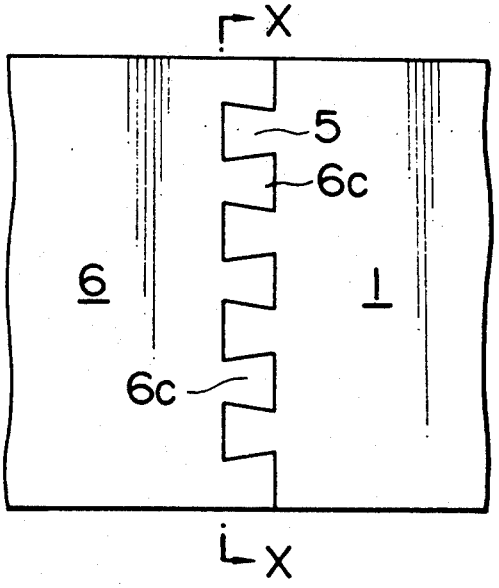

In the example shown in FIG. 22(*a*), in either one of the two rolled plates to be joined together; for example, in the rolled plate, the base portion of the concave parts has a larger width than the tip portion with respect to the example shown in FIG. 3. That is, the concave parts are shapes so that $g_1$ is greater than $g_2$. When such a plate is rolled, the deformation occurs in the way shown in FIG. 22(*b*), and joining forces between the rolled plates 1, 6 become stronger, and the resistance against pulling forces in the rolling direction becomes larger.

Figure 23:
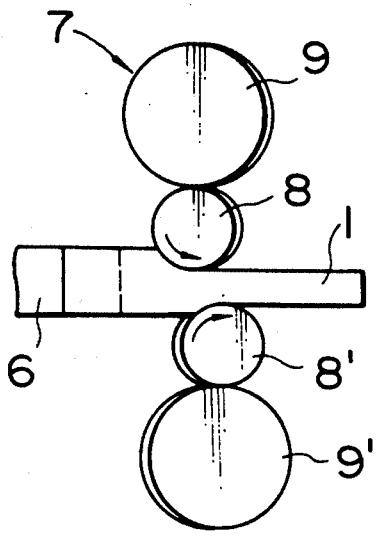
FIGS. 23 and 24 show the cross section along line X—X in FIG. 22(*b*).
Figure 24:
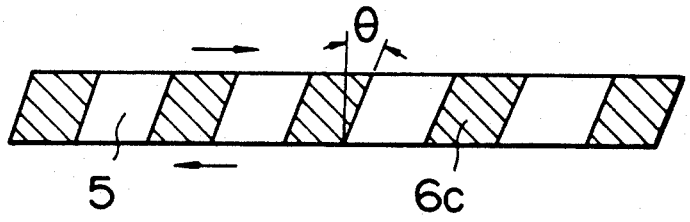

FIGS. 23 and 24 show another example. In this example, as shown in FIG. 4, the axes of the upper and lower work rolls 8, 8', as well as those of the upper and lower backup rolls 9, 9', on the finishing mill 7 cross each other, and the rolled plates are rolled under such arrangement of the rolls. The angle of crossing is arbitrary and can be very small. For example, it may be about one degree. When rolled under this arrangement of the rolls, the convex parts 5 and 6c of the rolled plates 1 and 6 are deformed in the directions indicated by the arrows as shown in FIG. 24, and the rolled plates are now joined with an angle $\theta$ whose value is, for example, about one degree. As a result, the joining strength in the vertical direction can be increased. While FIG. 24 shows a cross section of FIG. 22(*b*), the same effect can be achieved for the shapes of joining portions shown in FIG. 3 and FIGS. 18 to 21.

As explained hereinabove, according to the rolled plates joining method of the present invention, complicated operations required for conventional inlaying with a jigsaw shape, wherein path lines of preceding and following rolled plates are slided and the plates themselves are moved upward or downward, become unnecessary since the present inventive method requires only inlaying on the same path line in parallel with just butting the top end and the tail end of the plates that have been subjected to separate cutting processes.

Furthermore, since side edges of the plate ends are partially joined, separation of the following rolled plate from the preceding rolled plate before introduced into No. 1 stand of the finishing mill train is prevented. After the rolling, a strong joining is attained due to self entanglement into jigsaw shapes by uneven broadening of the plate material being rolled at the parallel inlay.

Since the joining is limited to a part of the side edge, problems associated with joining the full width by riveting, clamping, arc welding, or high frequency pressure welding, such as long period of time for the joining, large scale equipment and the like, are avoided.

We claim:

1. In a method for joining rolled plates in a continuous rolling line wherein the tail end part of a preceding rolled plate and the head end part of a following rolled plate are joined after rough rolling and then subjected to continuous finish rolling, the improvement which comprises forming the tail end of the preceding rolled plate and the head end of the following rolled plate into a nearly rectangular convex and concave shape so as to inlay each other;

joining the convex part and the concave part in the same plane as the rolling line; and then subjecting the joined plates to continuous finish rolling.

2. The method of claim 1, wherein the base portion of the concave part on either the preceding or following rolled plate has a larger width than the tip portion thereof.

3. In a method for joining rolled plates in a continuous rolling line wherein the tail end part of a preceding rolled plate and the head part of a following rolled plate are joined after rough rolling and then subjected to continuous finish rolling, the improvement which comprises:

cutting the plates so that the head and tail end parts fit together and form a parallel inlay;

forming a side surface of the parallel inlay in a taper shape in the direction of the plate thickness at a desired location of either the head end part or the tail end part or of both parts; and joining the head end of the following plate with the tail end of the preceding plate by inlaying both ends in the same plane.

4. In a method for joining rolled plates in a continuous rolling line wherein the tail end part of a preceding rolled plate and the head end part of a following rolled plate are joined after rough rolling and then subjected to continuous finish rolling, the improvement which comprises:

cutting the head end part and the tail end part of the respective roughly rolled plates so as to form a parallel inlay shape in such a way that both ends are able to inlay by butting each other in the same plane;

inlaying the cut parts with each other in a complementary manner in the same plane; and joining only a part of a side edge of the inlay.

5. The method of claim 1, 3, or 4 wherein the parallel inlay is formed on each of the preceding and following rolled plates in only a center portion thereof, and a flat portion is provided on either side of the center portion.

6. The method of claim 5, wherein upper and lower work rolls and upper and lower backup rolls are arranged so that their axes cross each other, and the rolled plates are rolled through this arrangement.

7. The method of claim 4 wherein the base portion of an indented part on either the preceding or following rolled plate has a larger width than the tip portion thereof.

8. The method of claim 1, 3, 4, 2 or 7 wherein upper and lower work rolls and upper and lower backup rolls are arranged so that their axes cross each other, and the rolled plates are rolled through this arrangement.

* * * * *